US006695719B1

(12) United States Patent
Maruoka

(10) Patent No.: US 6,695,719 B1
(45) Date of Patent: Feb. 24, 2004

(54) GOLF BALL

(75) Inventor: Kiyoto Maruoka, Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/641,561

(22) Filed: Aug. 18, 2000

(30) Foreign Application Priority Data

Aug. 30, 1999 (JP) ..... 11-242934

(51) Int. Cl.[7] ..... A63B 37/06
(52) U.S. Cl. ..... 473/378
(58) Field of Search ..... 473/378

(56) References Cited

U.S. PATENT DOCUMENTS 5,759,113 A * 6/1998 Lai et al.
6,045,461 A * 4/2000 Yamagishi et al.
6,126,559 A * 10/2000 Sullivan et al.
6,190,269 B1 * 2/2001 Moriyama
6,193,617 B1 * 2/2001 Mertens
6,290,613 B1 * 9/2001 Irii et al.
6,290,614 B1 * 9/2001 Kennedy, III et al.
6,302,810 B2 * 10/2001 Yokota
6,309,314 B1 * 10/2001 Sullivan et al.
6,319,152 B1 * 11/2001 Takesue et al.
6,319,155 B1 * 11/2001 Moriyama et al.

FOREIGN PATENT DOCUMENTS

GB A2311293 9/1997
JP A8141113 6/1996

* cited by examiner

*Primary Examiner*—Raleigh W. Chiu
*Assistant Examiner*—Nini F. Legesse
(74) *Attorney, Agent, or Firm*—Birch, Stewart, Kolasch & Birch, LLP

(57) ABSTRACT

A golf ball is composed of a core layer (1) and a cover layer (3) covering the core layer (1). The cover layer (3) is composed of a synthetic resinous composition whose Young's modulus measured by a split Hopkinson's bar tester lies in the range of 100 Mpa to 350 Mpa both inclusive and whose loss factor measured by the split Hopkinson's bar tester lies in the range of 0.2 to 0.45 both inclusive, when an impact bar of the split Hopkinson's bar tester collides with the golf ball at a speed of 14.0 m/sec.

4 Claims, 4 Drawing Sheets

GOLF BALL

BACKGROUND OF THE INVENTION

1. Field of the Invention

The present invention relates to a golf ball and more particularly to a golf ball having a cover layer made of synthetic resin.

2. Description of the Related Art

A flight distance is one of the important performances of the golf ball demanded by a golfer. The golf ball that flies a long distance refreshes the golfer and contributes to gaining good scores. It is necessary to improve the repulsive performance of the golf ball to improve the flight distance thereof.

Feeling is another important performance of the golf ball demanded by the golfer. The golf ball for which the golfer has a soft feeling gives the golfer a sense of security and contributes to the stability of swinging.

That is, it is important that the golf ball has a good repulsion performance and gives the golfer a soft feeling. To achieve this, various investigations have been made to improve the physical property of the golf ball. For example, in Japanese Patent Application Laid-Open No. 10-249, there is disclosed a golf ball having improved values in the physical property of the golf ball such as the hardness of the cover thereof, its bending elastic modulus, and the like. Other values of physical property of the golf ball such as its compressive strain amount, and Young's modulus and loss factor, both of which are measured by a viscoelastic spectrometer have been also investigated.

The repulsion performance and the golfer's feeling are manifested in the state in which the golf ball is actually hit, namely, in a dynamic state. On the other hand, the above-described hardness, bending's elastic modulus, compressive strain amount, Young's modulus, and loss factor are so-called static physical properties of the golf ball. Thus, no matter how much the static physical properties are investigated, it is difficult to achieve the improvement of the dynamic performance sufficiently.

A repulsive viscoelasticity spectrometer can be used as a means for measuring the physical property of the golf ball in the dynamic state. The repulsive viscoelasticity spectrometer measures the physical property of a specimen by applying a dynamic strain thereto. In Japanese Patent Application Laid-Open No. 8-141113, there is disclosed a golf ball having a cover whose Young's modulus measured by the repulsive viscoelasticity spectrometer lies within a predetermined range.

The speed of the strain imparted to the material of the golf ball by the repulsive viscoelasticity spectrometer is as low as 0.001/sec to 0.1/sec, and a maximum strain is also as low as 0.01% to 2%. This is because the material of the golf ball has a high hardness and is thus not deformed greatly by a force applied thereto by the repulsive viscoelasticity spectrometer. On the other hand, when the golf ball is actually hit by a golfer, the speed of the strain of the golf ball lies in the range of 2000/sec to 5000/sec and its maximum strain is in the range as high as 5% to 25%. That is, the golf ball undergoes a high-speed and large deformation. There is a big difference between the degree of the strain of the golf ball in the case where a force is applied thereto by the repulsive viscoelasticity spectrometer and the degree of the strain thereof when it is actually hit. Therefore, the repulsive viscoelasticity spectrometer does not measure the dynamic property of the golf ball in a state similar to the state in which it is actually hit. To improve the repulsive performance of the golf ball and give the golfer a soft feeling when it is hit, it is necessary to optimize the dynamic property of the golf ball in a state similar to the state in which the golf ball is actually hit.

SUMMARY OF THE INVENTION

The present invention has been made in view of the above-described problems. Thus, it is an object of the present invention to provide a golf ball having an improved repulsion performance and giving a golfer a soft feeling when it is hit owing to its dynamic property optimized, based on measurement of the dynamic property in a state similar to the state in which the golf ball is actually hit.

To achieve the object, according to the present invention, there is provided a golf ball composed of a core layer and a cover layer, wherein the cover layer is made of a synthetic resinous composition whose Young's modulus measured by a split Hopkinson's bar tester lies in the range of 100 Mpa to 350 Mpa both inclusive and whose loss factor measured by the split Hopkinson's bar tester lies in the range of 0.2 to 0.45 both inclusive, when an impact bar of the split Hopkinson's bar tester collides with the golf ball at a speed of 14.0 m/sec.

The golf ball of the present invention has a cover layer made of a synthetic resinous composition. The Young's modulus of the synthetic resinous composition and the loss factor thereof both measured by the split Hopkinson's bar tester lie within a predetermined range. As will be described later, in measurement to be made by the split Hopkinson's bar tester, a specimen undergoes a high-speed and large strain. Accordingly, the viscoelastic characteristic value (Young's modulus and loss factor) of the specimen can be measured in a state similar to the state in which a golf ball is actually hit. It is possible to enhance the dynamic performance of the golf ball, namely, the repulsion performance thereof and feeling by optimizing the Young's modulus and the loss factor thereof.

In the cover layer, the Young's modulus of the cover layer measured by the split Hopkinson's bar tester lies in the range of 100 Mpa to 350 Mpa both inclusive. Because the Young's modulus lies within the range, the golf ball of the present invention has a preferable repulsion performance and gives a golfer a soft feeling when it is hit. That is, if the Young's modulus of the cover layer is less than the range, the repulsion performance thereof may deteriorate, whereas if the Young's modulus thereof is more than the range, the golf ball may give the golfer a hard feeling when it is hit. From this point of view, it is preferable that the Young's modulus of the cover layer lies in the range of 150 Mpa to 250 Mpa.

The loss factor of the cover layer measured by the split Hopkinson's bar tester (hereinafter may be referred to as merely "loss factor") is in the range of 0.2 to 0.45. Because the loss factor is in this range, the golf ball has a preferable repulsion performance and gives the golfer a soft feeling when it is hit. That is, if the loss factor of the cover layer is lower than the range, the the golf ball may be hard, which may give a bad feeling to the golfer when it is hit, whereas if the loss factor thereof is higher than the range, the repulsion performance of the golf ball may deteriorate. From this point of view, it is preferable that the loss factor of the cover layer lies in the range of 0.2 to 0.35 both inclusive.

The thickness of the cover layer is favorably in the range of 0.5 mm to 4.0 mm both inclusive and more favorably in the range of 1.2 mm to 3.0 mm both inclusive. When the thickness of the cover layer is in this range, the golf ball has a preferable repulsion performance and gives the golfer a soft feeling when it is hit.

The golf ball of the present invention has a core and a cover. The cover may consist of a single layer or a plurality of cover layers. When the cover has a plurality of cover layers, it is necessary that the Young's modulus of the outermost cover layer and the loss factor thereof are in the above range. The cover may be a thread rubber-wound core or may be a solid core consisting of solid rubber. The solid core may be a single core layer or a plurality of core layers.

It is preferable that the core layer contains, as a main component thereof, polybutadiene containing a cis-1,4 linkage at 90% or more in a micro-structure thereof. Thereby, the golf ball has improved repulsion performance.

DETAILED DESCRIPTION OF THE PREFERRED EMBODIMENTS

The embodiments of the present invention will be described below with reference to the drawings.

Figure 1:
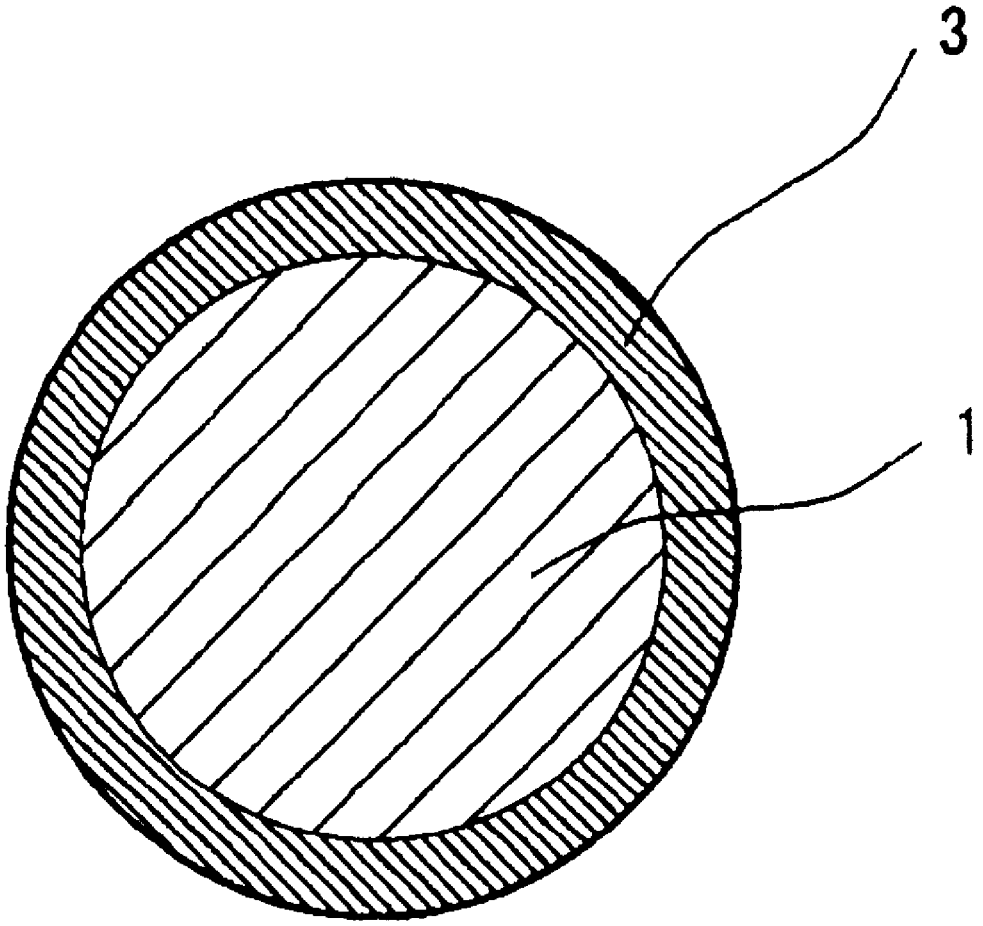
FIG. 1 is a sectional view showing a golf ball according to an embodiment of the present invention.

FIG. 1 is a sectional view showing a golf ball according to an embodiment of the present invention. The golf ball has a core layer 1 and a cover layer 3 covered with the core layer 1. That is, the golf ball is a two-piece golf ball. The diameter of the golf ball is about 42.8 mm. The diameter of the core layer 1 is about 38.4 mm. The thickness of the cover layer 3 is about 2.2 mm. Although not shown in FIG. 1, the golf ball has a paint layer applied to the peripheral surface of the cover layer 3.

The cover layer 3 is made of a synthetic resinous composition whose Young's modulus measured by a split Hopkinson's bar tester lies in the range of 100 MPa to 350 MPa both inclusive and whose loss factor measured thereby lies in the range of 0.2 to 0.45 both inclusive. Ionomer resin containing α, β-unsaturated carboxylic acid as a copolymerization component is used as a preferable synthetic resin for the cover layer 3. As the α, β-unsaturated carboxylic acid, it is possible to use acrylic acid, methacrylic acid, maleic acid, an fumaric acid. In particular, the acrylic acid and the methacrylic acid can be preferably used because the loss factor thereof can be easily set within the above-described range.

It is preferable to use the ionomer resin in combination with polyurethane, polyamide or polyester. It is easy to set the Young's modulus and the loss factor within the above-described range by the use of these synthetic resins in combination. Preferably, the mixing weight ratio of the polyurethane, the polyamide and the polyester to the ionomer resin is in the range of 5/95 to 30/70 both inclusive.

In the ionomer resin, the carboxylic radical is neutralized with ions of metals such as sodium, magnesium, lithium, zinc, and potassium. One kind of the metal ion may be used or two or more kinds thereof may be used in combination. It is preferable to use zinc ions and sodium ions in combination, magnesium ions and lithium ions in combination, and magnesium ions and sodium ions in combination.

It is possible to add an appropriate amount of a colorant, a deterioration inhibitor, and the like as necessary to the synthetic resinous composition composing the cover layer 3 in the range in which the Young's modulus thereof is maintained in the range of 100 Mpa to 350 Mpa and the loss factor thereof is maintained in the range of 0.2 to 0.45 both inclusive.

Although the golf ball has a single cover layer 3, it may have two or more cover layers. In this case, the outermost cover layer can be molded from the synthetic resinous composition having the Young's modulus in the range of 100 Mpa to 350 Mpa both inclusive and the loss factor in the range of 0.2 to 0.45 both inclusive.

The core layer 1 is composed by cross-linking the rubber composition. Base rubber constituting the core layer 1 includes polybutadiene, natural rubber, polyisoprene, styrene-butadiene copolymer, and ethylene-propylene-diene copolymer. The polybutadiene containing the cis-1,4 linkage at 90% or more in its micro-structure is most favorable in view of the repulsion performance of the golf ball.

Known cross-linking agents can be used to form the core layer 1. Cross-linking of the rubber composition by a metallic salt of aliphatic acid or fatty ester are preferable to allow the golf ball to have preferable repulsion performance and to give a golfer a good feeling. A metallic salt of unsaturated carboxylic acid is a preferable cross-linking agent. More specifically, a monovalent or bivalent metallic salt having carbon atoms in the range of three to eight can be preferably used. Zinc acrylate is particularly preferable. It is preferable to add 15 to 50 parts by weight of the zinc acrylate to 100 parts by weight of the rubber composition.

It is preferable to use an organic peroxide in combination with the cross-linking agent in cross-linking the rubber composition to form the core layer 1. Dicumyl peroxide and 1,1-bis (t-butylperoxide-3,3,5-trimethyl-cyclohexane) can be preferably used as preferable organic peroxides. To allow the golf ball to have preferable repulsion performance and give the golfer a good feeling, it is preferable to add 0.1–2.0 parts by weight of the organic peroxide to 100 parts by weight of the rubber composition.

In forming the core layer 1, zinc white may added to the rubber composition as a cross-linking assistant to allow the golf ball to give the golfer a good feeling. Thiophenols may be added to the rubber composition as a cross-linking retarder to enhance the repulsion performance of the golf ball.

The core layer 1 is formed by heating/cross-linking the kneaded and preformed rubber composition in a die. It is preferable to cross-link the rubber composition at a temperature in the range of 140° C. to 180° C. If the cross-linking temperature is lower than the lower limit, insufficient cross-linking occurs, which may lead to an insufficient repulsion performance of the golf ball. On the other hand, if the cross-linking temperature is higher than the upper limit, excess cross-linking occurs, which may cause the golfer to have unfavorable feeling for the golf ball.

The golf ball has a single core layer but may have two or more core layers. As described previously, the diameter of the core layer 1 is about 38.4 mm. The diameter of the core layer 1 may be larger or smaller than 38.4 mm. In the case where the diameter of the core layer 1 is altered, the thickness of the cover layer 3 is altered in correspondence thereto.

Figure 2:
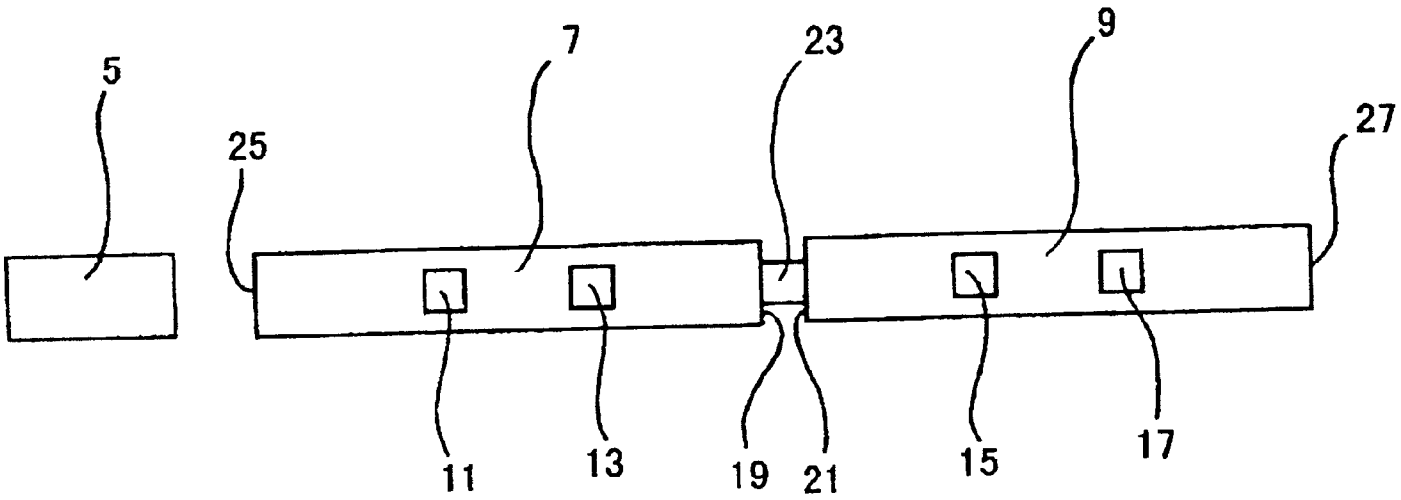
FIG. 2 is a front view showing a split Hopkinson's bar for measuring the Young's modulus of the golf ball and the loss factor thereof shown in FIG. 1.

FIG. 2 is a front view showing the split Hopkinson's bar for measuring the Young's modulus and loss factor of the cover layer 3 of the golf ball. The split Hopkinson's bar has an impact bar 5, an input bar 7, and an output bar 9 arranged in a straight line. A first strain gauge 11 and a second strain gauge 13 are installed on the input bar 7. A third strain gauge 15 and a fourth strain gauge 17 are installed on the output bar 9. A disc-shaped specimen 23 is put between a rear end 19 of the input bar 7 and a front end 21 of the output bar 9. The specimen 23 may be formed by molding a resinous composition for the cover layer 3 into the shape of the specimen or may be cut off from the golf ball. The specimen 23 is molded from the resinous composition at 140° C. to 230° C. to flow it smoothly and prevent bite of air. The split Hopkinson's bar tester is left in an environment having a room temperature of 232 C. and a relative humidity of 50%.

Each of the impact bar 5, the input bar 7, and the output bar 9 is a cylinder made of polymethyl methacrylate. The sectional diameter, Young's modulus, and specific gravity thereof are 20 mm, 5300 Mpa, and 1.19, respectively. The length of the impact bar 5 is 100 mm. The length of each of the input bar 7 and the output bar 9 (the input bar 7 and the output bar 9 may be hereinafter referred to as "stress bar") is 2000 mm. The first strain gauge 11 is installed on the input bar 7 at a position 900 mm spaced from the rear end 19 thereof. The second strain gauge 13 is installed on the input bar 7 at a position 600 mm spaced from the rear end 19 thereof. The third strain gauge 15 is installed on the output bar 9 at a position 300 mm spaced from the front end 21 thereof. The fourth strain gauge 17 is installed on the output bar 9 at a position 600 mm spaced from the front end 21 thereof. The length (namely, distance between the rear end 19 of the input bar 7 and the front end 21 of the output bar 9) of the specimen 23 is 4 mm. The sectional diameter of the specimen 23 is 18 mm.

The split Hopkinson's bar tester is used to examine properties of a metal material and is primarily inappropriate for evaluating a synthetic resinous material such as the cover layer 3. In the split Hopkinson's bar tester shown in FIG. 2, the impact bar 5, the input bar 7, and the output bar 9 are made of synthetic resin. The length of the input bar 7 and that of the output bar 9 are as large as 2000 mm. A long distance is provided between the first strain gauge 11 and the rear end 19 of the input bar 7 and between the second strain gauge 13 and the rear end 19 of the input bar 7. Thus, the split Hopkinson's bar tester is also suitable for measuring the viscoelastic characteristic value of the resinous composition such as the cover layer 3.

In measuring the Young's modulus and the loss factor of the specimen 23 with the split Hopkinson's bar tester, initially, the impact bar 5 comes into collision with the front end 25 of the input bar 7 at a speed of 14 m/sec. As a result, an incident strain wave is generated. The incident strain wave proceeds toward the rear gauge 19 of the input bar 7. A part of the incident strain wave is reflected by the rear gauge 19 of the input bar 7 and proceeds to the front gauge 25 of the input bar 7 as a reflected strain wave. A part of the incident strain wave transmits through the specimen 23 and propagates from the rear gauge 19 of the input bar 7 to the output bar 9 as a transmitted strain wave and proceeds to the rear gauge 27 of the output bar 9.

The incident strain wave is measured by the first strain gauge 11 and the second strain gauge 13. The frequency of a strain wave generated by the hitting of the impact bar 5 against the front gauge 25 of the input bar 7 is in the range of 2.5 kHz to 5.0 kHz. A waveform which is measured by each strain gauge is a synthesized wave including a noise of a high-frequency wave higher than 10 kHz. The synthesized wave is passed through a low-pass filter of 10 kHz to remove the noise. Further, a zero compensation is performed to make a base line value of the history of the incident strain wave zero. Values measured by the strain gauges should be zero until before the strain wave reaches them. But actually, a slight amount of noise is inputted to the strain gauges. Thus, the values measured by the strain gauges deviate from zero. The zero compensation is performed to prevent the measuring accuracy from deteriorating due to the deviation. Fourier transformation of each of time-axis strains obtained at the first strain gauge 11 and the second strain gauge 13 is performed to compute a frequency-axis strain. A transmission function is derived from the frequency-axis strain at each of the first strain gauge 11 and the second strain gauge 13. A frequency-axis strain at the rear gauge 19 of the input bar 7 is estimated, considering the ratio of the distance X1 between the first strain gauge 11 and the rear gauge 19 of the input bar 7 to the distance X2 between the second strain gauge 13 and the rear gauge 19 of the input bar 7 and based on the transmission function. A time-axis strain (history of strain) $\epsilon i$ of the incident strain wave at the rear gauge 19 of the input bar 7 is obtained by performing an inverse Fourier transformation of the frequency-axis strain.

Similarly, a time-axis strain (history of strain) $\epsilon r$ of the reflected strain wave at the rear gauge 19 of the input bar 7 is obtained from the reflected strain wave measured by the first strain gauge 11 and the second strain gauge 13. Similarly, a time-axis strain (history of strain) $\epsilon t$ of the transmitted strain wave at the front gauge 21 of the output bar 9 is obtained from the transmitted strain wave measured by the third strain gauge 15 and the fourth strain gauge 17.

By using an equation (1) shown below, a strain speed $\epsilon'$ of the of the specimen 23 is computed from the $\epsilon i$, $\epsilon r$, and $\epsilon t$ thus obtained.

$$\epsilon'=(CO/L)\cdot\epsilon i-\epsilon r-\epsilon t)=((E/\rho)^{1/2}/L)\cdot(\epsilon i-\epsilon r-\epsilon t) \quad (1)$$

where C0 is propagation speed (m/s) of wave in stress bar, L is length (m) of specimen, E is Young's modulus ($N/m^2$) of stress bar, and $\rho$ is density of stress bar ($kg/m^3$) By using an equation (2) shown below, a strain $\epsilon$ of the of the specimen 23 is computed from the $\epsilon i$, $\epsilon r$, and $\epsilon t$.

$$\varepsilon = (C0/L)\cdot\int_0^t(\varepsilon i-\varepsilon r-\varepsilon t)\,dt = ((E/\rho)^{1/2}/L)\cdot\int_0^t(\varepsilon i-\varepsilon r-\varepsilon t)\,dt \quad (2)$$

where C0 is propagation speed (m/s) of wave in stress bar, L is length (m) of specimen, E is Young's modulus ($N\ m^2$) of stress bar, and $\rho$ is density of stress bar ($kg/m^3$).

By using an equation (3) shown below, a stress $\sigma$ of the of the specimen 23 is computed from the $\epsilon i$, $\epsilon r$, and $\epsilon t$.

$$\sigma=(E\cdot A/(2As))\cdot(\epsilon i+\epsilon r+\epsilon t)=(E\cdot D^2/(2(Ds)^2))\cdot(\epsilon i+\epsilon r+\epsilon t) \quad (3)$$

where E is Young's modulus ($N\ m^2$) of stress bar, A is sectional area ($m^2$) of stress bar, As is sectional area ($m^2$) of specimen, D is diameter (m) of stress bar, and Ds is diameter (m) of specimen.

Figure 3:
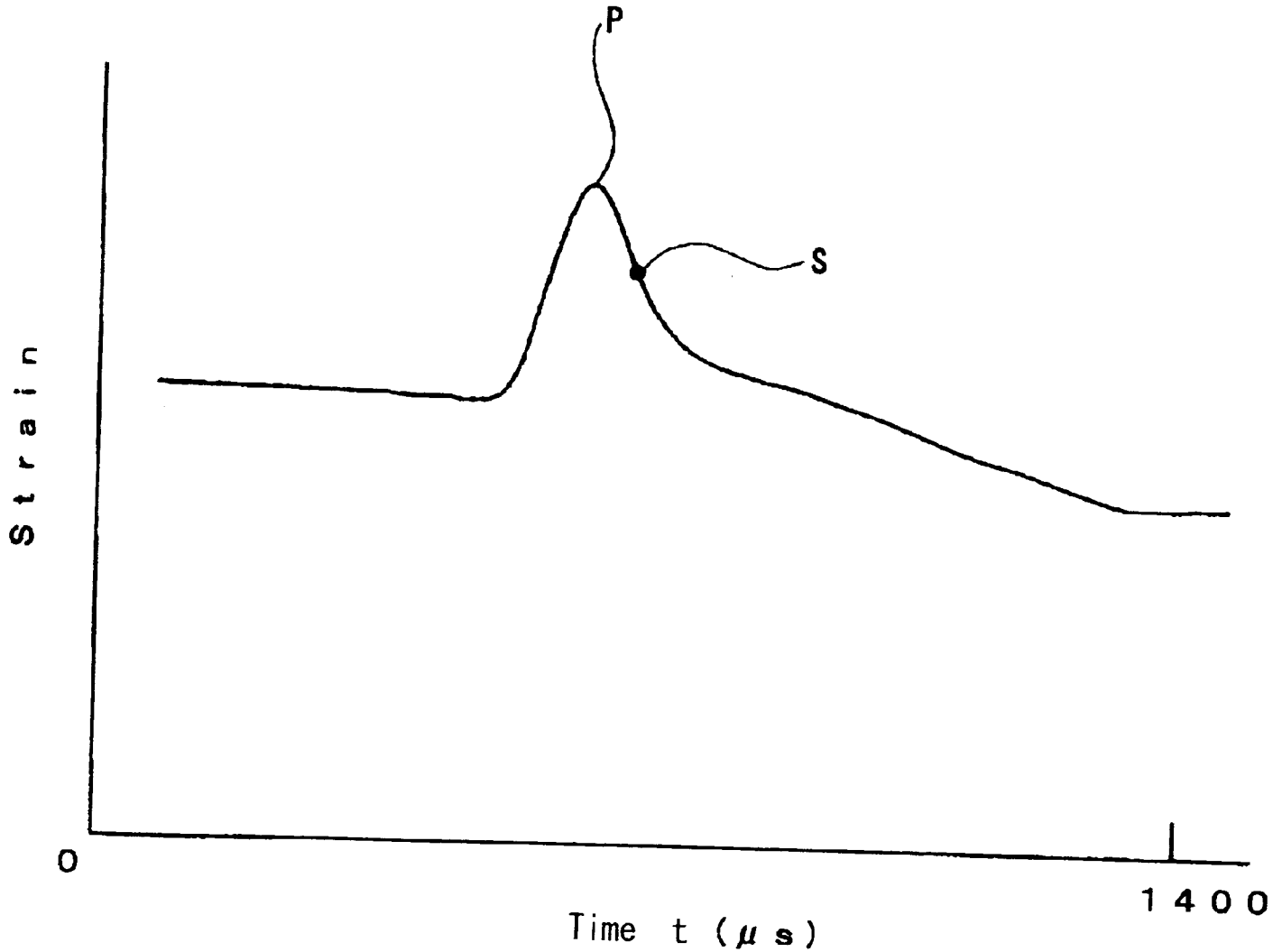
FIG. 3 is a graph showing a state before a compensation of the history of a strain of the of a specimen is performed.

FIG. 3 is a graph showing the obtained history of the strain of the of the specimen 23. The curve of FIG. 3 is smooth for some time after a peak P and becomes irregular thereafter. A point S is selected from the smooth portion located after the peak P. A tangent to the curve at the point S is drawn. A relaxation time $\lambda$ is derived from the intersection point of the tangent and the time axis. It is possible to obtain the entire history of the strain a smooth curve by replacing a curve determined by using an equation (4) shown below with the curve located subsequently to the point S. Thereby, it is possible to remove the influence of the noise on a viscoelastic characteristic value finally obtained.

$$\epsilon(t)=\epsilon o\cdot e^{-t/\lambda} \quad (4)$$

where $\epsilon o$ is strain at point of contact.

The point P can be selected anywhere in the smooth portion but normally, it is selected at 100 $\mu$s after the peak P.

Similarly, by using an equation (5) shown below, it is possible to obtain a smooth curve of the entire stress history. Thereby, it is possible to remove the influence of the noise on a viscoelastic characteristic value finally obtained.

$$\sigma(t)=\sigma o\cdot e^{-t/\lambda} \quad (5)$$

where $\sigma o$ is stress at point of contact.

Figure 4:
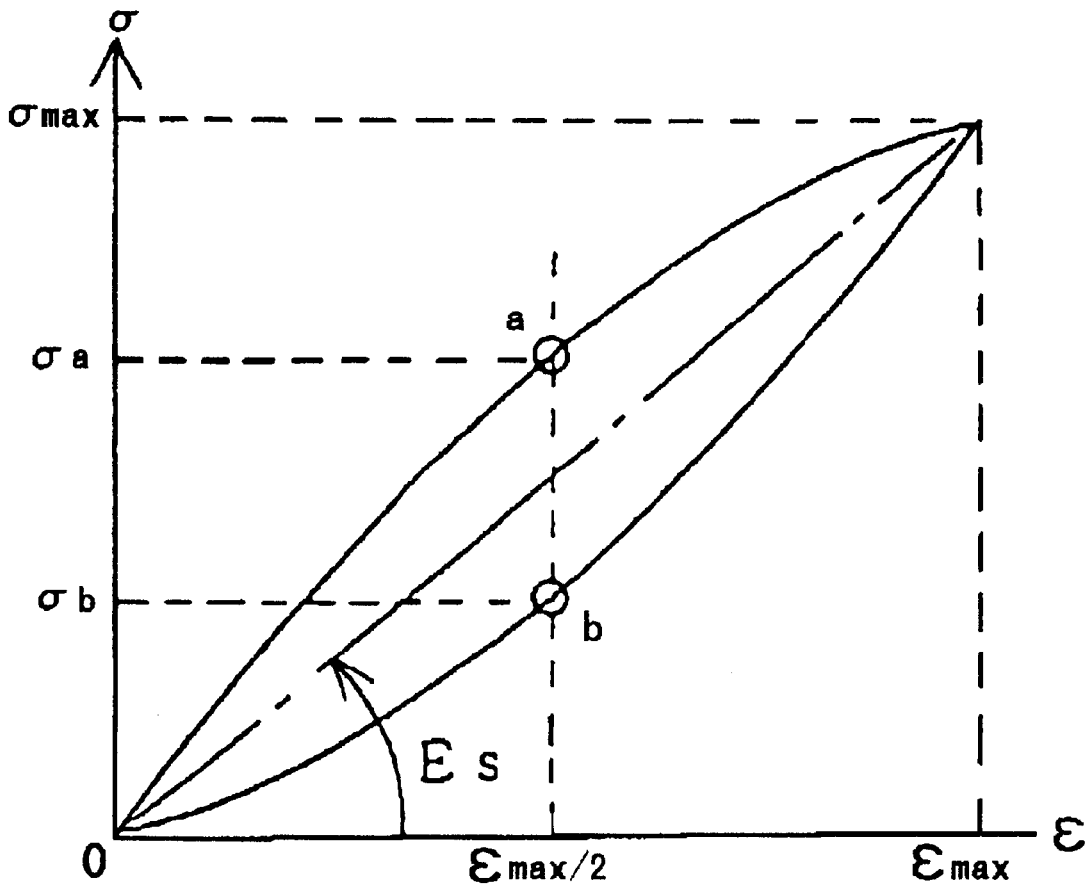
FIG. 4 is a graph showing a typical stress-strain curve.

A stress-strain curve is determined from the history of the strain of the of the specimen 23 and the history of the stress of the thereof obtained by performing the compensation. FIG. 4 is a graph showing a typical stress-strain curve. By using an equation (6) shown below, the Young's modulus of the of the specimen 23 is computed from the stress-strain curve.

$$Es=\sigma max/\epsilon max \quad (6)$$

By using an equation (7) shown below, a phase angle $\delta$ is computed from the stress-strain curve shown in FIG. 4:

$$\delta=\sin^{-1}((\sigma a-\sigma b)/\sigma max) \quad (7)$$

The loss factor (tan $\delta$) is computed from the phase angle $\delta$.

When the impact bar 5 collides with the front end 25 of the input bar 7 at a speed of 14 m/sec, the strain speed of the specimen is in the range of 2000 to 2500 per second, and the strain amount thereof is in the range of 15% to 25%. The deformation behavior of the strain is similar to that obtained when the golf ball is hit. That is, Young's modulus and the loss factor of the specimen measured by the split Hopkinson's bar tester are dynamic properties obtained in a state similar to the state in which the golf ball is actually hit.

EXAMPLES

First Example

The following components were introduced into an enclosed kneader and kneaded to obtain a rubber composition: 100 parts by weight of polybutadiene ("BR11" (trade name) manufactured by Nippon Goseigomu Inc.); 30 parts by weight of zinc acrylate ("Sunseller SR" (trade name) manufactured by Sanshin Kagaku Inc.); 20 parts by weight of zinc white; 0.5 parts by weight of dicumyl peroxide ("Parkmill" (trade name) manufactured by Ouchi Shinkokagaku Inc.); and 0.5 parts by weight of diphenyl disulfide serving as a cross-linking retarder. The rubber composition was extruded by an extruder to prepare a columnar preform. The preform was introduced into a spherical die and compressed/heated at 160° C. for 30 minutes to prepare a core (core layer) composed of cross-linked rubber and having a diameter of 38.4 mm.

Then, the following ionomer resins were mixed with one another, extruded by the extruder, and pulverized into a pellet: 50 parts by weight of ionomer resin ("Highmilan 1605" (trade name) manufactured by Mitsui Dupont Polychemical Inc.); 40 parts by weight of another ionomer resin ("Highmilan 1706" (trade name) manufactured by Mitsui Dupont Polychemical Inc.); 5 parts by weight of another ionomer resin ("Highmilan 1856" (trade name) manufactured by Mitsui Dupont Polychemical Inc.); and 5 parts by weight of another ionomer resin ("Iotech 7010" (trade name) manufactured by Exon Chemical Inc. The core was covered with the resulting resinous composition forming a cover layer by using an injection molder. After pre-treatment is performed, paint was applied to the cover layer to obtain the golf ball of the first example. The resinous composition used for the cover layer was molded into a disc-shaped specimen having a diameter of 18 mm and a thickness of 4 mm. The Young's modulus and the loss factor of the specimen were measured by the split Hopkinson's bar tester shown in FIG. 2. The Young's modulus and loss factor thereof were 295.5 Mpa and 0.2013, respectively.

Second Example

The golf ball of the second example was prepared in a manner similar to that of the first example except that the amount of each ionomer resin used in the first example was altered as shown in table 1. The Young's modulus and loss factor of the resinous composition used for the cover layer of the golf ball were 194.0 Mpa and 0.2236, respectively.

Third and Fourth Examples

The golf ball of the third example was prepared in a manner similar to that of the first example except that ethylene methyl methacrylate resin ("Newchrel AN4311" (trade name) manufactured by Mitsui Dupont Polychemical Inc.) was used instead of "Iotech 7010". The Young's modulus and the loss factor of the resinous composition used for the cover layer of the golf ball were 156.2 Mpa and 0.2845, respectively. The golf ball of the fourth example was prepared in a manner similar to that of the first example except that a thermoplastic elastomer of the polyester family ("Hightrel 4047" (trade name) manufactured by Toray Dupont Inc.) was used instead of "Iotech 7010". The Young's modulus and the loss factor of the resinous composition used for the cover layer of the golf ball were 160.2 Mpa and 0.2579, respectively.

Fifth and Sixth Examples

The golf ball of the fifth example was prepared in a manner similar to that of the first example except that 30 parts by weight of "Highmilan 1706" was used, that the "Iotech 7010" was not used, and that 15 parts by weight of ethylene methyl methacrylate resin ("Newchrel AN4311") was used. The Young's modulus and the loss factor of the resinous composition used for the cover layer of the golf ball were 118.6 Mpa and 0.4098, respectively. The golf ball of the sixth example was prepared in a manner similar to that of the first example except that 30 parts by weight of "Highmilan 1706" was used, that the "Iotech 7010" was not used, and that 15 parts by weight of the thermoplastic elastomer of the polyester family (above-described "Hightrel 4047") was used. The Young's modulus and the loss factor of the resinous composition used for the cover layer of the golf ball were 127.6 Mpa and 0.3768, respectively.

First Comparison Example

The golf ball of the first comparison example was prepared in a manner similar to that of the first example except that as the synthetic resin of the cover layer, 50 parts by weight of the ionomer resin (above-described "Highmilan 1605" was used and that the 50 parts by weight of the ethylene methyl methacrylate resin (above-described "Newchrel AN4311") was used. The Young's modulus and the loss factor of the resinous composition used for the cover layer of the golf ball were 124.9 Mpa and 0.6206, respectively.

Second and Third Comparison Example

The golf ball of the second comparison example was prepared in a manner similar to that of the first example except that as the synthetic resin of the cover layer, only the ethylene methyl methacrylate resin (above-described "Newchrel AN4311") was used. The Young's modulus and the loss factor of the resinous composition used for the cover layer of the golf ball were 54.8 Mpa and 0.3725, respectively. The golf ball of the third comparison example was prepared in a manner similar to that of the first example except that as the synthetic resin of the cover layer, only thermoplastic elastomer of the polyester family (above-described "Hightrel 4047") was used. The Young's modulus and the loss factor of the resinous composition used for the cover layer of the golf ball were 47.5 Mpa and 1.1033, respectively.

Measurement of Coefficient of Repulsion

In the condition of the room temperature 23° C., a hollow bar made of aluminum collided with each golf ball at a speed of 45 m/sec to measure the coefficient of repulsion of each golf ball. Table 1 shows the result. The golf ball having a higher coefficient of repulsion is superior in its repulsion performance and thus flies a long distance.

Measurement of Impulsive Force

A driver ("Dunlop DP10" (trade name) manufactured by SUMITOMO RUBBER INDUSTRIES, LTD.) was installed on a swing machine manufactured by True Temper Inc. Each golf ball was hit with the driver at a head speed of 45 m/sec. To measure the maximum acceleration of each golf ball, an acceleration pick-up meter was installed on the side sole portion of the head such that the acceleration pick-up meter was coaxial with the flight direction of each golf ball. The maximum acceleration was multiplied by the weight (210 g) of the head to compute the impulsive force of each golf ball. Table 1 shows the result. The golf ball having a low impulsive force imparts a lower degree of impact to the golfer.

Feeling Test 100 golfers hit each golf ball so that they evaluate feeling they had for each golf ball. The golf balls were evaluated in four grades. That is, excellent golf balls that gave them a soft feeling were denoted as "three marks" Good golf balls that gave them a soft feeling were denoted as "two marks" Those that gave them a hard feeling were denoted as "zero mark". Table 1 shows the result.

TABLE 1

| | First E | Second E | Third E | Fourth E | Fifth E | Sixth E | First CE | Second CE | Third CE |
|---|---|---|---|---|---|---|---|---|---|
| Highmilan 1605 | 50 | 50 | 50 | 50 | 50 | 50 | 50 | — | — |
| Highmilan 1706 | 40 | 20 | 40 | 40 | 30 | 30 | — | — | — |
| Highmilan 1856 | 5 | 25 | 5 | 5 | 5 | 5 | — | — | — |
| Iotech 7010 | 5 | 5 | — | — | — | — | — | — | — |
| Newchrel AN4311 | — | — | 5 | — | 15 | — | 50 | 100 | — |
| Hightrel 4047 | — | — | — | 5 | — | 15 | — | — | 100 |
| Young's modulus (MPa) | 295.5 | 194.0 | 156.2 | 160.2 | 118.6 | 127.6 | 124.9 | 47.5 | 54.8 |
| Loss factor | 0.2013 | 0.2236 | 0.2845 | 0.2579 | 0.4098 | 0.3768 | 0.6206 | 1.1033 | 0.3725 |
| Repulsion coefficient | 0.7648 | 0.7575 | 0.7441 | 0.7463 | 0.7327 | 0.7381 | 0.7248 | 0.6974 | 0.7159 |
| Impulsive force (kgf) | 1452 | 1422 | 1385 | 1395 | 1326 | 1335 | 1297 | 1274 | 1278 |
| Feeling | 2.1 | 2.2 | 2.4 | 2.2 | 2.6 | 2.7 | 2.6 | 2.7 | 2.6 |

Where E is example, and CE is comparison example.

Referring to table 1, the golf balls of the comparison example have a low coefficient of repulsion because the golf ball of the first comparison example has a very large loss factor, the golf ball of the second comparison example has a very low Young's modulus, and the golf all of the third comparison example has a very low young's modulus and a very large loss factor. On the other hand, each of the golf balls of the first through sixth examples has a large coefficient of repulsion, a preferable impulsive force, and got good mark in the item of "feeling" because the Young's moduli thereof are in the range of 100 MPa to 350 Mpa and the loss factors thereof are in the range of 0.2 to 0.45. That is, the golf ball of the present invention is superior to the conventional golf ball.

As apparent from the foregoing description, the golf ball of the present invention has improved repulsion performance and gives a golfer a soft feeling when it is hit owing to its dynamic property optimized based on measurement of the dynamic property in a state similar to the state in which the golf ball is actually hit.

What is claimed is:

1. Method of selecting the most suitable material as a cover layer of a golf ball from a specimen which is made of a synthetic resin and has a viscoelastic characteristic which comprises:

(i) arranging said specimen of said cover layer between input bar and an output bar in a straight line, wherein the input bar has a first and a second strain gauge, and the output bar has a third and fourth strain gauge, (ii) hitting a front gauge of the input bar at impact speed of 14.0 m/sec to generate an incident strain wave and a reflected wave in the input bar, and a transmitted strain wave propagating in the input bar, the specimen and the output bar, (iii) measuring said incident strain wave and said reflected strain wave with first and second strain gauges installed on the input bar and measuring a transmitted strain wave with a third and fourth strain gauges installed on the output bar, (iv) computing Young's modulus and a loss factor of each specimen from a viscoelastic characteristic value thereof, obtained by estimating the incident strain wave, the reflected strain wave and the transmitted strain wave, and (v) selecting the most suitable specimen whose Young's modulus lies in the range of 100 Mpa to 350 Mpa both inclusive and whose loss factor lies in the range of 0.2 to 0.45 both inclusive as a material of the cover layer of the golf ball.

2. Method of selecting the most suitable material as a cover layer of a golf ball from a specimen which is made of a synthetic resin and has a viscoelastic characteristic which comprises:

(i) arranging said specimen of said cover layer between input bar and an output bar in a straight line, wherein the input bar has a first and a second strain gauges, and the output bar has a third and fourth strain gauge, (ii) hitting a front gauge of the input bar to generate an incident strain wave and a reflected wave in the input bar, and a transmitted strain wave propagating in the input bar, the specimen and the output bar, wherein a strain speed of the specimen is in the range of 2000 to 2500 per second, (iii) measuring said incident strain wave and said reflected strain wave with first and second strain gauges installed on the input bar and measuring a transmitted strain wave with a third and fourth strain gauges installed on the output bar, (iv) computing Young's modulus and a loss factor of each specimen from a viscoelastic characteristic value thereof, obtained by estimating the incident strain wave, the reflected strain wave and the transmitted strain wave, and (v) selecting the most suitable specimen whose Young's modulus lies in the range of 100 Mpa to 350 Mpa both inclusive and whose loss factor lies in the range of 0.2 to 0.45 both inclusive as a material of the cover layer of the golf ball.

3. Method of selecting the most suitable material as a cover layer of a golf ball from a specimen which is made of a synthetic resin and has a viscoelastic characteristic which comprise:

(i) arranging said specimen of said cover layer between input bar and an output bar in a straight line, wherein the input bar has a first and a second strain gauges, and the output bar has a third and fourth strain gauge, (ii) hitting a front gauge of the input bar to generate an incident strain wave and a reflected wave in the input bar, and a transmitted stain wave propagating in the input bar, the specimen and the output bar, wherein a strain amount of the specimen is in the range of 15% to 25%, (iii) measuring said incident strain wave and said reflected strain wave with first and second strain gauges installed on the input bar and measuring a transmitted strain wave with a third and fourth strain gauges installed on the output bar, (iv) computing Young's modulus and a loss factor of each specimen from a viscoelastic characteristic value thereof, obtained by estimating the incident strain wave, the reflected strain wave and the transmitted strain wave, and (v) selecting the most suitable specimen whose Young's modulus lies in the range of 100 Mpa to 350 Mpa both inclusive and whose loss factor lies in the range of 0.2 to 0.45 both inclusive as a material of the cover layer of the golf ball.

4. Method of selecting the most suitable material as a cover layer of a golf ball from a specimen which is made of a synthetic resin and has a viscoelastic characteristic which comprise:

(i) arranging said specimen of said cover layer between (i) input bar and an output bar in a straight line, wherein the input bar has a fist and a second strain gauges, and the output bar has a third and fourth strain gauge, (ii) hitting a front gauge of the input bar to generate an incident stain wave and a reflected wave in the input bar, and a transmitted stain wave propagating in the input bar, the specimen and the output bar, (iii) measuring said incident stain wave and said reflected stain wave with first and second stain gauges installed on the input bar and measuring a transmitted stain wave with a third and fourth strain gauges installed on the output bar, (iv) computing Young's modulus and a loss factor of each specimen from a viscoelastic characteristic value thereof, obtained by estimating the incident strain wave, the reflected stain wave and the transmitted strain wave, and (v) selecting the most suitable specimen as a material of the cover layer of the golf ball.

* * * * *